US011244554B1

(12) United States Patent
Volodymyrovych et al.

(10) Patent No.: US 11,244,554 B1
(45) Date of Patent: Feb. 8, 2022

(54) METHOD AND A DEVICE FOR SIGNAL TRANSMISSION FROM WIRED SECURITY SENSORS AND/OR FIRE ANNUNCIATORS

(71) Applicant: AJAX SYSTEMS CYPRUS HOLDINGS LTD, Nicosia (CY)

(72) Inventors: Konotopskyi Oleksandr Volodymyrovych, Sharjah (AE); Karnaukh Kostiantyn Konstiantynovych, Kharkov (UA); Biliavskyi Mykyta Borysovych, Kyiv (UA)

(73) Assignee: AJAX SYSTEMS CYPRUS HOLDINGS LTD, Nicosia (CY)

( * ) Notice: Subject to any disclaimer, the term of this patent is extended or adjusted under 35 U.S.C. 154(b) by 0 days.

(21) Appl. No.: 17/345,630

(22) Filed: Jun. 11, 2021

(30) Foreign Application Priority Data

Aug. 5, 2020 (UA) ..... a 2020 05094

(51) Int. Cl.
*G08B 25/14* (2006.01)
*G08B 25/00* (2006.01)
*G08B 25/06* (2006.01)

(52) U.S. Cl.
CPC ..... *G08B 25/14* (2013.01); *G08B 25/001* (2013.01); *G08B 25/007* (2013.01); *G08B 25/06* (2013.01)

(58) Field of Classification Search
CPC ..... G08B 25/14; G08B 25/001; G08B 25/06; G08B 25/007
See application file for complete search history.

(56) References Cited

U.S. PATENT DOCUMENTS 4,284,849 A * 8/1981 Anderson ..... H04M 11/04 379/110.01
5,598,456 A * 1/1997 Feinberg ..... H04M 11/04 348/E7.081

(Continued)

*Primary Examiner* — Ojiako K Nwugo
(74) *Attorney, Agent, or Firm* — Saliwan, Llyod & Eisenschenk

(57) ABSTRACT

The invention relates to alarm systems using wired and wireless transmission systems. A method for transmitting a signal from wired security sensors and/or fire annunciators is proposed, the method comprising wire-connecting the security sensor and/or fire annunciator to an input from a set of inputs of a signal transmission device, which comprises an analogue-to-digital converter that is coupled to a controller and a power supply unit. Each of the set of inputs of the signal transmission device is associated with an input zone from a set of the input zones. Information regarding the input zones and the inputs of the signal transmission device associated therewith is stored within a storage device that is coupled to the controller. The controller periodically receives wired connection resistance parameters for each input zone, and the received wired connection resistance parameters of the input zone are compared with predefined resistance parameters of this input zone, which are stored within said storage device. A status is assigned for each input zone depending on results of comparison of the received resistance parameters with the predefined resistance parameters, including an "alarm" status for the input zone that has the wired connection resistance parameters, which differ from the predefined resistance parameters. The controller forms a data packet comprising information regarding a status of each input zone, for which the wired connection of the security sensors and/or fire annunciators has been performed, as well as an information regarding an operation status of the signal transmission device. The formed data packet is sent via a radio module, which is coupled to the controller, to a central station that is configured at least to (Continued)

inform regarding a receipt of the "alarm" status. Also, a signal transmission device for implementation of the above-described method is proposed.

15 Claims, 3 Drawing Sheets

(56) References Cited

U.S. PATENT DOCUMENTS

| | | | | |
|---|---|---|---|---|
| 6,441,733 | B1 * | 8/2002 | Unterschultz | G08B 29/08 340/540 |
| 9,167,242 | B1 * | 10/2015 | Meyer | H04N 17/004 |
| 10,492,068 | B1 | 11/2019 | Konotopskyi et al. | |
| 2003/0122672 | A1 * | 7/2003 | Billiard | G08B 13/1454 340/568.2 |
| 2009/0309578 | A1 * | 12/2009 | Cochran | A61B 5/6833 324/207.16 |
| 2013/0120132 | A1 * | 5/2013 | Hicks, III | H04W 4/90 340/501 |
| 2013/0121239 | A1 * | 5/2013 | Hicks, III | H04W 4/12 370/328 |
| 2014/0191661 | A1 * | 7/2014 | Riggs | H05B 47/19 315/132 |
| 2017/0110003 | A1 * | 4/2017 | Barson | G08B 25/04 |
| 2019/0340917 | A1 * | 11/2019 | Kull | H01L 51/5268 |

* cited by examiner

METHOD AND A DEVICE FOR SIGNAL TRANSMISSION FROM WIRED SECURITY SENSORS AND/OR FIRE ANNUNCIATORS

CROSS-REFERENCE TO RELATED APPLICATION

This application claims priority to Ukrainian Application No. a 2020 05094, filed Aug. 5, 2020, which is hereby incorporated by reference in its entirety.

FIELD OF THE INVENTION

The invention relates to alarm systems, namely to systems for an alarm signal transmission, wherein the signal regarding a location of occurrence of the alarm conditions is transmitted to a central station, e.g., fire or police telegraph systems, using wired and wireless transmission systems.

BACKGROUND

Wireless alarm systems are known, which comprise security sensors and fire annunciators disposed at an object to be protected (a room, a building, a territory etc.) and to a central station. A wireless data exchange is performed between the security sensors and fire annunciators from one side and the central station from another side by means of an encrypted radio protocol. To this end, each of the security sensors, fire annunciators and the central station are equipped with radio modules. These radio modules are configured to receive and transmit radio data packets within working slots of a single radio frequency or at several radio frequencies. In order to perform the data exchange, the security sensors and the fire annunciators are periodically called over by the central station to receive their status (ping verification with a predefined frequency). This status includes data, according to which a failure of the security sensors and the fire annunciators is determined. The central station forms a data packet that includes a status data of the security sensors and of the fire annunciators as well as a status data of the central station, and sends the formed packet to a security guard console or a user device via known wireless data communication protocols, such as Ethernet, Wi-Fi, and other similar ones. In such a way, an operational performance of the security sensors and fire annunciators is controlled and the security guard or the user is informed in case of their activation or failure. An example of such system is described in U.S. Pat. No. 10,492,068B1 dated Nov. 26, 2019. When using the described alarm system at objects, which already comprise wired security sensors or fire annunciators (devices having a wired output, hereinafter referred to as the wired devices), a problem with their connection to a wireless central station arises. The same problem arises at objects, wherein the data exchange via a radio channel is limited or absent. It may be caused by a presence of radio interferences, a reduced radio transparency of walls of the building, etc. Such problem is resolved by using a wireless module with an input being connected to a wired output of the security sensors or fire annunciators followed by data exchange between wired security sensors or fire annunciators via the radio channel. Such wireless modules are produced by the company AJAX (https://ajax.systems/products/transmitter/). By means of these two modules, the wired security sensors or fire annunciators are transformed into wireless devices and are completely integrated into the wireless alarm system. At the same time, functions of such sensors are expanded due to the transmission of such data, which could not be received from the wired device, to the central station. However, another problem arises when using the wireless modules. For example, the object has 50 wired security sensors and/or fire annunciators disposed thereon. Their connection to the central station requires 50 wireless modules. It significantly complicates the system as well as its mounting and maintenance. It is difficult to reveal a reason for absence of the signal whether it is a damage of the security sensor (fire annunciator) or their wireless module. Also, a problem with powering a large number of various devices arises. During the operation process of such system, the 50 wireless modules "clog" a radio ether with numerous data packets sent to the central station. A time limitation for the device presence in the radio ether may exist at some objects. Thus, a transmission of a large number of "small" data packets, which are periodically transmitted to the central station, is not acceptable.

TASK OF THE INVENTION

According to the invention, a method and a device for transmitting a signal from wired security sensors and/or fire annunciators are provided, which allow to address the problems posed above, namely to simplify the integration of the wired security sensors and/or fire annunciators, which already present at an object, into a wireless alarm system. As a variant, the proposed method and device are also suitable for building a new alarm system at the object, and the system can be equipped with both wireless and wired security sensors and fire annunciators. Therewith, the claimed invention provides a functionality of the wired security sensors and/or fire annunciators that is identical to the one of the wireless devices of the same function.

SUMMARY OF THE INVENTION

The posed task is resolved by the proposed method for transmitting a signal from wired security sensors and/or fire annunciators, the method comprising wire-connecting the security sensor and/or fire annunciator to an input of a signal transmission device, which comprises an analogue-to-digital converter that is coupled to a controller and a power supply unit, wherein each of a set of inputs of the signal transmission device is associated with an input zone from a set of input zones, an information regarding the input zones and the inputs of the signal transmission device associated therewith are stored in a storage device that is coupled to the controller, and performing the following steps: periodically receiving, by the controller, of wired connection resistance parameters for each input zone, comparing the received wired connection resistance parameters of the input zone with predefined resistance parameters of this input zone, which are stored within said storage device, and assigning a status for each input zone depending on results of comparison of the received resistance parameters with the predefined resistance parameters, including an "alarm" status for the input zone that has the wired connection resistance parameters, which differ from the predefined resistance parameters, forming an information regarding a status of each input zone for which the wired connection has been performed, forming, by the controller, a data packet that includes the information regarding the status of each input zone, for which the wired connection of the security sensors and/or fire annunciators has been performed, as well as an information regarding an operation status of the signal transmission device, sending, by the controller, the formed data packet via a radio module, which is coupled to the controller, to a central station that is configured at least to inform regarding a receipt of the "alarm" status.

According to one of preferable embodiments of the method, the predefined resistance parameters, which are stored within the storage device, include an interval of a "standard" resistance value that corresponds to a status of the alarm absence.

According to another preferable embodiment of the method, the interval of the "standard" resistance value includes intervals of "failure" resistance values, each of them being arranged near a boundary of the interval of the "standard" resistance value.

According to further preferable embodiment of the method, the assigning of the status for each input zone includes assigning a "failure" status for the input zone that has the wired connection resistance parameters, which correspond to one of the intervals of "failure" resistance values.

According to further preferable embodiment of the method, the security sensors and/or fire annunciators are powered by the power supply unit of the signal transmission device.

According to further preferable embodiment of the method, the controller being used is the one that is configured to assign another input zone from the set of input zones to connect the security sensor or fire annunciator without changing the wired connection of this security sensor or fire annunciator to the input of the signal transmission device.

According to further preferable embodiment of the method, a first wired connection of the security sensors and/or fire annunciators to the signal transmission device includes a primary measuring of the wired connection resistance for each input zone followed by setting the measured resistance parameters as the predefined resistance parameters for this input zone and storing the same within the storage device.

Also, the posed task is resolved by the proposed signal transmission device for transmitting the signal from the wired security sensors and/or fire annunciators according to the above-described method, which comprises: the controller that is coupled to the analogue-to-digital converter and the radio module, the power supply unit of the device, the set of inputs for the wired connection of the security sensors and fire annunciators, each of them being associated with an input group, which form the set of input groups, and the storage device that is coupled to the controller and designed to store the information regarding the input zones and inputs for the wired connection associated therewith. Therewith, the controller is configured to set predefined resistance parameters for each input zone and to store the same within the storage device. Also, the controller is configured to periodically call over each input zone that has the wired connection and to receive, in response, the wired connection resistance parameters for each such input zone. Also, the controller is configured to compare the received wired connection resistance parameters with the predefined resistance parameters stored within the storage device, as well as to assign the status for each input zone, including the "alarm" status for the input zone that has the wired connection resistance parameters, which differ from the predefined resistance parameters. Also, the controller is configured to form the data package that includes the information regarding the status of each input zone, for which the wired connection of the security sensors and/or fire annunciators has been performed, as well as regarding the operation status of the signal transmission device, and to send the formed data package via the radio module to the central station that is configured at least to inform regarding the receipt of the "alarm" status.

According to one of preferable embodiments of the device, the storage device comprises the predefined resistance parameters, which include an interval of a "standard" resistance value that corresponds to a status of the alarm absence. In such case, the interval of the "standard" resistance value includes intervals of "failure" resistance values, each of them being arranged near a boundary of the interval of the "standard" resistance value.

According to another preferable embodiment of the device, the controller is configured to assign a "failure" status for the input zone that has the wired connection resistance parameters, which correspond to one of the intervals of "failure" resistance values.

According to further preferable embodiment of the device, the power supply unit is configured to provide power from an alternating current mains and to provide power from an accumulator battery.

According to further preferable embodiment, the device is further equipped with connection terminals for power circuits of the security sensors and connection terminals for power circuits of the fire annunciators. In this case, the device further comprises a power supply unit for the security sensors and fire annunciators that is coupled to the power supply unit of the device and connected to the connection terminals for power circuits of the security sensors and connection terminals for power circuits of the fire annunciators.

According to further preferable embodiment, the controller is suitable to measure the wired connection resistance of each input zone that comprises the connected security sensors and/or fire annunciators.

A technical effect provided by using the method and the device according to the invention lies in the simplification of the data transmission from the wired security sensors and/or fire annunciator due to the formation of a single packet with the statuses of the security sensors and fire annunciators, and sending it to the central station via a single slot of the radio channel. An advantage provided lies in the absence of loading of the radio ether with data from each security sensor and/or fire annunciator. Therewith, the implementation of the method implies the control of the operation capability of the connection of each security sensor and/or fire annunciator upon receipt of the resistance parameters of this connection. Also, the proposed device simplifies its mounting and maintenance by setting the resistance parameters, which are necessary to determine the status of the security sensor and/or fire annunciator during the primary measurement of the resistance when the device is connected for the first time. The proposed device implies a simplification of change of its setting during the operation process by changing the input zone for the separate security sensor and/or fire annunciator without change of its physical connection and location. The alarm system that is built on the basis of such device provides the expansion of functions of the wired security sensors and/or fire annunciators by connecting the same to the device that is equipped with a wireless data transmission means (radio module).

The above-described method and device enable to implement the distribution of the entire set of the security sensors and/or fire annunciators at the object, where they are mounted, into the input zones. In the context of the present invention, the input zone means several security sensors and/or fire annunciators from the entire set, which are grouped according to any principle, preferably, it is a location of the same, e.g., within a single room, at a single floor, etc. The distribution into the input groups is convenient in case of a large number of the security sensors and/or fire annunciators at the object, since it enables to simplify the informing of the user (or the security guard console) regarding an event that has been fixed by the security sensor or fire annunciator. For example, in a normal mode, the user receives information regarding each sensor that has been activated. When the user receives the information regarding several sensors, which have been activated simultaneously, it will be difficult for them to determine a part of the object, where the event has occurred. When dividing into the input groups, the user receives the information from a specific group of sensors. Knowing the principle of formation of this group, it is simpler for the user to determine a part of the object, where the event has occurred. That is, the input zone is substantially a separate device for the user, and the user receives and uses the status information of the same.

The above-described device enables to connect several input zones by replacing a wired assembly for creation of a network and by sending signals of the wired security sensors and fire annunciators to the central station. Several wired devices may be combined within each input zone. Therefore, there is no need in using the wireless module for each wired device for transmitting their signals to the central station. By means of only one radio module that is coupled to the controller, the signal transmission device sends, to the ether, a single packet with the status information regarding the all input zones, for which the wired connection of the security sensors and/or fire annunciators has been performed, as well as regarding the operation status of the controller. For example, when there are 18 connected input zones, the signal transmission device will form the data packet that contains the information regarding the status of 19 devices (the status of the 18 input zones+the status of the device itself). That is, the radio ether is not clogged with 18 small packets, rather the single packet is transmitted to the ether.

The data packet is formed by the controller on the basis of the comparison of the received wired connection resistance parameters with the predefined resistance parameters, which are stored within the storage device, that is performed by it, and assignment of the status for each input zone. The predefined resistance parameters may be stored within the storage device in the form of a table with various statuses for various intervals of the resistance values written therein, including the intervals for the "alarm" status. Upon receipt of the wired connection resistance values of each input zone, the controller of the device compares these values with the data from the table and determines the status of each input zone, including the "alarm" status for the input zone that has the wired connection resistance parameters, which differ from the predefined resistance parameters. Therefore, the signal transmission device performs a preliminary processing of the signals received from each input zone and forms a common data packet that accounts for the status of all the input zones before sending the same to the central station. In case of activation of only one wired device within one input zone, the controller anyway will send the data packet that is formed from the data from all the wired devices with indication of the input zone and those device, from which the "alarm" status or the "failure" status has been received.

It should be appreciated that the foregoing general description and further detailed description are solely illustrative and explanatory, and do not limit the claimed invention.

BRIEF DESCRIPTION OF THE DRAWINGS

The provided drawings, which are included into the present description of the invention and constitute its part, illustrate embodiments of the invention and serve to explain the invention principles along with the description.

In FIG. 3, the following designations are used: NO—normally open sensor, NC—normally closed sensor, SC—a state of the sensor, when the resistance falls down to zero.

DETAILED DESCRIPTION

Figure 1:
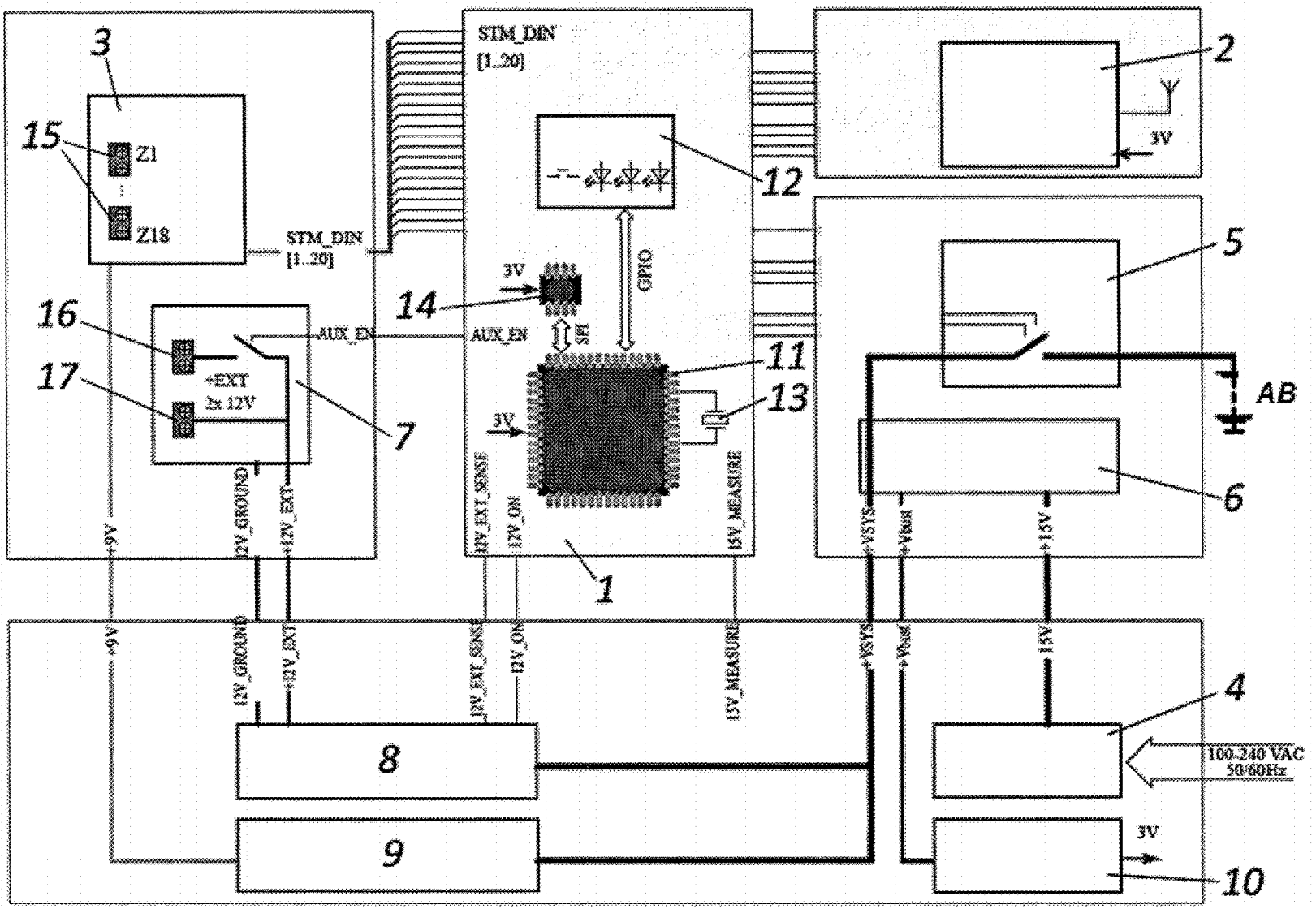
FIG. 1 is block diagram that demonstrates a structure of the device for transmitting a signal from wired security sensors and/or fire annunciators.

An illustrative embodiment of the invention is described hereinafter in detail using said figures. Implementations, which are disclosed in the following description of the embodiment, do not encompass all implementations of the invention, rather they serve solely to provide an additional explanation of the essence thereof.

The signal transmission device can be conveniently classified into eleven functional units (FIG. 1): a controller unit 1 (MCU), a radio module 2 (RF module), a signal inputs unit 3 (Signal Inputs unit), a device power supply unit 4 (Primary Supply unit), an emergency power supply unit 5 (Battery Management unit), accumulators' charging unit 6 (Battery Charger unit), a power supply unit for the security sensors and fire annunciators 7 (Power Output unit), an output current protection unit 8 (Output Current protection unit), a power supply for current measuring devices 9 (LDO), a microcontroller power supply unit 10 (MCU power DC/DC).

The controller unit 1 comprises a controller 11, e.g., a 32-bit ARM-microcontroller, a user interface unit 12 (Human Interface unit), a quartz generator 13 and a storage device (a flash drive) 14. The controller 11 is equipped with an internal random access memory (RAM) for temporary storage of data when executing a program by the controller. For the presented example of the signal transmission device, the controller 11 is equipped with an analogue-to-digital converter having inputs, which are coupled to outputs of the signal inputs unit 3. However, an embodiment of the device is possible, wherein the analogue-to-digital converter represents a separate unit thereof that is coupled to the signal inputs unit 3 and to the controller 11. The controller 1 is also coupled to the radio module 2. The user interface unit 12 comprises LED-indicators for the device operation, a switcher for switching the device on/off and tampers (a button on the device board that is released in case of an unauthorized opening of the housing, removing from a fixation means and attempting to take the device off a surface, thereby initiating an event and transmission of the "alarm" status to the central station).

The radio module 2 is designed as a transceiving module that is capable to operate within a wide range of radio frequencies, including bandwidths of 315, 433, 868 and 915 MHz. The radio module 2 comprises a fully integrated frequency synthesizer, a power amplifier, a crystal oscillator, a demodulator, a modulator and a mechanism of the protocol Enhanced ShockBurst™. Frequency channels and settings of the protocol are easily programmed via the SPI interface. The current consumption is very low, in the RX mode is only 16 mA. Built-in power shutdown modes and standby mode enable saving the energy. The data exchange between the controller unit 1 and the radio module 2 is made via the standard SPI interface, with a fault line and additional DIO lines.

The signal inputs unit 3 is equipped with inputs 15 for the wired connection, each corresponding to one input zone from the set of input zones $Z_1 \ldots Z_n$, wherein n is a number of the input zones (FIG. 1). The inputs 15 for the wired connection may be designed as terminals for connecting circuits of the security sensors and fire annunciators, i.e. contact groups, which will open or close when these signal devices are activated. FIG. 1 shows the signal inputs unit 3 that comprises eighteen inputs 15 for the wired connection, which correspond to eighteen input zones Z1 . . . Z18, i.e. n=18. The signal inputs unit 3 comprises external linear drivers, which are coupled to the inputs 15 for the wired connection, and their number corresponds to the number of the inputs 15. Said linear drivers are designed to supply power to the inputs 15 and to convert the signal level from the security sensors and/or fire annunciators, which are coupled via the inputs 15, into a signal level that must be at the input of the analogue-to-digital converter of the controller 11. The linear drivers are also designed to control a state of the tampers of the user interface unit 12.

Figure 2:
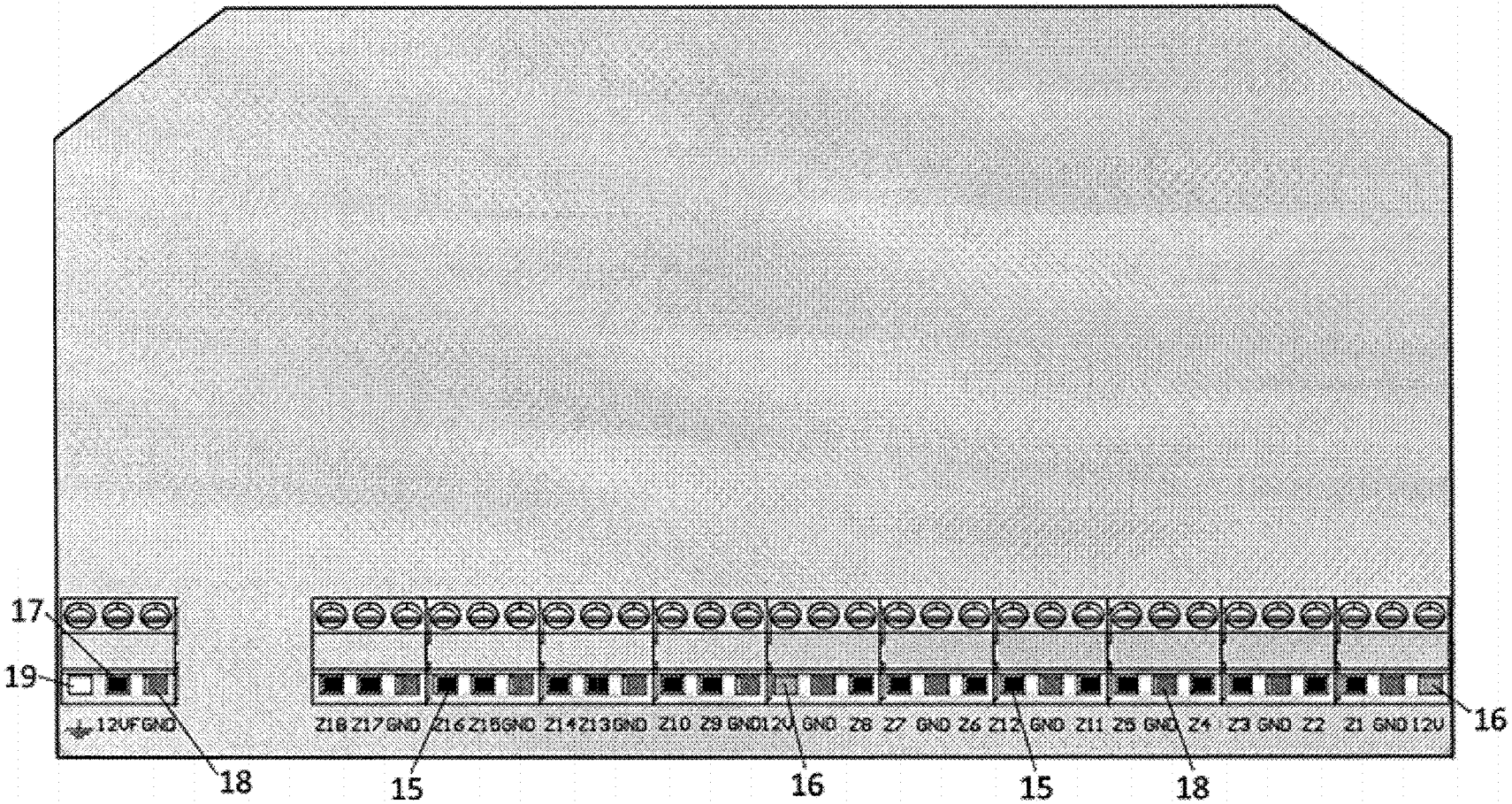
FIG. 2 is an illustration of a board that depicts the arrangement of the inputs for the wired connection and connection terminals for power circuits of the security sensors and fire annunciators.

The device power supply unit 4 is configured to supply power from an AC mains and to supply power from an accumulator battery. To this end, the device power supply unit 4 comprises a module-type AC-DC power source having an universal range of alternating current input voltage of 85-305 V. The device power supply unit 4 provides powering of the emergency power supply unit 5. The emergency power supply unit 5 comprises a lead acid accumulator battery (AB) designed for 4.5 Ah or 7.2 Ah 12 V, the battery being coupled thereto via the X5 connector. The emergency power supply unit 5 comprises an OR ring circuit that protects the AB in case of a wrong polarity. The accumulators' charging unit 6 comprises a DC-DC voltage down converter having a function of limiting the current of the AB charge. The accumulators' charging unit 6 also provides powering of other units via the +Vsys line. The power supply unit for the security sensors and fire annunciators 7 is coupled to the device power supply unit 4 and connected to the connection terminals of the power circuits of the security sensors 16 (12 V) and connection terminals of the power circuits of the fire annunciators 17 (12 VF), as well as to the connection terminals for general power circuits and alarm of the sensors and fire annunciators 18 (GND) and to a grounding connection terminal 19 (FIG. 2). The output current protection unit 8 provides a current protection for the security sensors and fire annunciators, which are connected to the power supply unit for the security sensors and fire annunciators 7.

Figure 3:
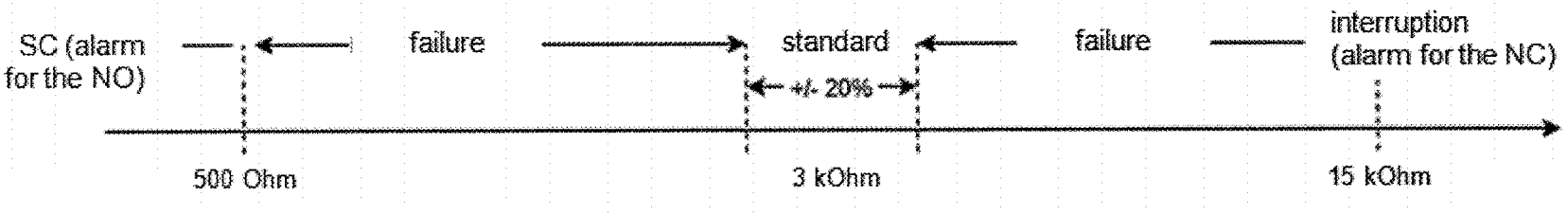
FIG. 3 is an illustration that depicts the determination of the wired connection resistance parameters for each input zone (exemplified by arrangement of ranges of the resistance values for a stub having an end-of-line resistor of 3 kOhm).

The controller 11 is programmed to:

set the predefined resistance parameters for each input zone from the set $Z_1, \ldots Z_n$ and to store them in the storage device 14, periodically call over each input zone from the set $Z_1 \ldots Z_n$ that has the wired connection and to receive, in response, the wired connection resistance parameters for each such input zone, compare the received wired connection resistance parameters with the predefined resistance parameters stored in the storage device 14, as well as to assign the status for each input zone, including the "alarm" status for the input zone that has the wired connection resistance parameters, which differ from the predefined resistance parameters, form a data packet comprising an information regarding the status of each input zone, for which the wired connection of the security sensors and/or fire annunciators has been performed, as well as regarding the operation status of the controller 11, send the formed data packet via the radio module 2 to the central station (not shown in the figures) that is configured at least to inform regarding the receipt of the "alarm" status, assign a "failure" status for the input zone that has the wired connection resistance parameters, which correspond to one of the intervals of "failure" resistance values. Therewith, the storage device 14 has preliminary stored the predefined resistance parameters of each input zone (or resistance parameters, which are shared between all set of the input zones $Z_1 \ldots Z_n$), which include an interval of a "standard" resistance value that corresponds to a status of the alarm absence. The interval of the "standard" resistance value includes intervals of "failure" resistance values, each of them being arranged near a boundary of the interval of the "standard" resistance value (FIG. 3).

The transmission of the signal from the leading security sensors and/or fire annunciators by means of the described device is performed in the following way.

For example, a room to be secured has fifty security sensors and fire annunciators arranged therein. These security sensors and fire annunciators are wire-connected, e.g., via a stub, to the signal transmission device that has 18 inputs for the wired connection. Each of the inputs 15 of the signal transmission device is associated with the input zone from the set of the input zones. The set of the input zones is smaller than the maximum number of the security sensors and fire annunciators, which may be connected to the signal transmission device. For example, in order to connect 50 security sensors and fire annunciators, the signal transmission device may have 18 input zones. The signal transmission device with 18 inputs 15 for the wired connection has 18 input zones Z1 . . . Z18. Several security sensors or fire annunciators are connected to one input zone (to one input 15). The information regarding the input zones and the inputs 15 of the signal transmission device associated therewith is stored within the storage device 14.

When the signal transmission device is connected for the first time, the predefined resistance parameters for each input zone or shared resistance parameters for all input zones are set. The predefined resistance parameters are stored within the storage device 14. The determination of the resistance parameters in order to set them as the predefined ones is preferably performed by measuring the resistance of the wired connection for each input zone from the set Z1 . . . Z18, when the security sensors or fire annunciators are connected to the signal transmission device for the first time. The measured resistance parameters are set as the interval of the "standard" resistance value that corresponds to the status of the alarm absence. However, the user of the signal transmission device may set other predefined resistance parameters or change them programmatically. Usually, the interval of the "standard" resistance value is determined as measured (or given) resistance parameter +/−20% of its value.

The setting of the interval of the "standard" resistance value includes setting of the intervals of "failure" resistance values, each of them being arranged near a boundary of the interval of the "standard" resistance value. FIG. 3 illustrates an example of setting the intervals of the "failure" resistance values for the wired connection of the sensor (stub) that is equipped with an end-of-line resistor of 3 kOhm. This sensor with one resistor may have three states:

(i) An "interruption" state, when the resistance goes to infinity, (ii) A "standard" state, when the resistance of the input equals to the resistance of the sensor resistor, (iii) A "SC" state, when the resistance goes to zero.

FIG. 3 shows such a state of the sensor as normally closed sensor and normally opened sensor. The normally closed sensor means the sensor with the resistor connected in series, at the input with such sensor, the standard, the alarm (the interruption state) and the SC may be detected. The normally opened sensor means the sensor with the resistor connected in parallel, at the input with such sensor, the standard, the alarm (the SC state) and the interruption.

Additionally, a hysteresis at the boundary of the "standard"/"failure" resistance values is set. The hysteresis is an interval that is designed to avoid erroneous activations. The hysteresis value is +/−5% of the interval of the "standard" resistance values. The "failure" range is introduced for the case, when the resistance of the wired connection (stub) of the security sensors or fire annunciators to the signal transmission device falls between the "standard" resistance value and the resistance values, which correspond to the alarm status. This may be caused by oxidation of the wired connection contacts in the course of time or by the fact that the user has stated an erroneous resistance value of the stub when setting the predefined resistance values.

In the process of operation of the signal transmission device, the controller 11 periodically receives the resistance parameters of the wired connection of the security sensors and fire annunciators for each input zone. To this end, the analogue-to-digital converter of the controller 11 receives, at the input, the resistance parameters of the wired connection of the security sensors and fire annunciators. Upon receipt of the resistance parameters, the signal inputs unit 3 converts the signal level in the wired connection (stub) into a level that must be at the input of the analogue-to-digital converter. The controller 11 may detect a change in the state of the inputs having a length of impulses of 20 ms, 100 ms, 1 sec (according to the settings).

Therewith, the powering of the security sensors and fire annunciators is performed from the power supply unit 4 via the power supply unit for the security sensors and fire annunciators 7 and the connection terminals of the power circuits of the security sensors 16, and connection terminals of the power circuits of the fire annunciators 17, and to the connection terminals for general power circuits and alarm of the sensors and fire annunciators 18 respectively.

By comparing the received resistance parameters of the wired connection of the input zone with the predefined resistance parameters of this input zone, which are stored within the storage device 14, the status for each input zone is determined. It may be the "standard" status, if the wired connection resistance corresponds to the interval of the "standard" resistance value, i.e. to the predefined resistance parameters, or the "alarm" status for the input zone that has the resistance parameters of the wired connection, which differ from the predefined resistance parameters, or the "failure" status, if the wired connection resistance corresponds to the intervals of the "failure" resistance values.

Based on the statuses determined, the controller 11 forms the data packet comprising the information regarding the status of each input zone, for which the wired connection of the security sensors and fire annunciators has been performed, as well as the information regarding the operation status of the signal transmission device. Therewith, the "failure" status is not equivalent to the "alarm" status. For the "failure" status, the contacts of the wired connection must remain in the state, in which they were earlier (closed or opened). The "failure" status serves to inform the user regarding the resistance value that has fallen beyond the boundaries of the "standard" value, i.e. regarding an incorrect operation of the security sensors and fire annunciators. While the security sensors and fire annunciators will be activated in the usual "alarm" status determination mode. The user notification may be in the form of a message in the program management interface of the signal transmission device or the central station, or in the form of a LED-indication of the operation modes of the signal transmission device.

The data packet formed by the controller 11 is sent by the controller 11 to the central station via the radio module 2. The central station informs regarding the receipt of the "alarm" status, e.g., by sending a signal to the user electronic device that is equipped with the program management interface of the signal transmission device, or to the security guard console etc.

In the process of operation, the input zone may be changed to another one from the set of input zones to connect a certain security sensor or fire annunciator without changing the wired connection of this security sensor or fire annunciator to the input of the signal transmission device. This is made by managing the controller 11, e.g., via the program management interface of the signal transmission device.

The invention claimed is:

1. A method for transmitting a signal from wired security sensors and/or fire annunciators, the method comprising: wire-connecting the security sensor and/or fire annunciator to an input from a set of inputs of a signal transmission device, which comprises an analogue-to-digital converter that is coupled to a controller and a power supply unit, wherein each of the set of inputs of the signal transmission device is associated with an input zone from a set of input zones, and information regarding the input zones and the inputs of the signal transmission device associated therewith are stored in a storage device that is coupled to the controller; performing periodically receiving, by the controller, of wired connection resistance parameters for each input zone; comparing the received wired connection resistance parameters of the input zone with predefined resistance parameters of this input zone, which are stored within said storage device, and assigning a status for each input zone depending on results of comparison of the received resistance parameters with the predefined resistance parameters, including an "alarm" status for the input zone that has the wired connection resistance parameters, which differ from the predefined resistance parameters; forming an information regarding a status of each input zone for which the wired connection has been performed; forming, by the controller, a data packet that includes the information regarding the status of each input zone, for which the wired connection of the security sensors and/or fire annunciators has been performed, as well as an information regarding an operation status of the signal transmission device; and sending, by the controller, the formed data packet via a radio module, which is coupled to the controller, to a central station that is configured at least to inform regarding a receipt of the "alarm" status.

2. The method according to claim 1, wherein the predefined resistance parameters, which are stored within the storage device, include an interval of a "standard" resistance value that corresponds to a status of the alarm absence.

3. The method according to claim 2, wherein the interval of the "standard" resistance value includes intervals of "failure" resistance values, each of them being arranged near a boundary of the interval of the "standard" resistance value.

4. The method according to claim 3, wherein the assigning of the status for each input zone includes assigning a "failure" status for the input zone that has the wired connection resistance parameters, which correspond to one of the intervals of "failure" resistance values.

5. The method according to claim 1, wherein the security sensors and/or fire annunciators are powered by the power supply unit of the signal transmission device.

6. The method according to claim 1, wherein the controller being used is the one that is configured to assign another input zone from the set of input zones to connect the security sensor or fire annunciator without changing the wired connection of this security sensor or fire annunciator to the input of the signal transmission device.

7. The method according to claim 1, wherein a first wired connection of the security sensors and/or fire annunciators to the signal transmission device includes a primary measuring of the wired connection resistance for each input zone followed by setting the measured resistance parameters as the predefined resistance parameters for this input zone and storing the same within the storage device.

8. A device for signal transmission from wired security sensors and/or fire annunciators, which comprises: a controller that is coupled to an analogue-to-digital converter and a radio module; a power supply unit of the device; a set of inputs for a wired connection of the security sensors and fire annunciators, each of them being associated with an input group, which form a set of input groups; a storage device that is coupled to the controller and configured to store information regarding input zones and inputs for the wired connection associated therewith, wherein the controller is configured to set predefined resistance parameters for each input zone and to store the same in the storage device, wherein the controller is configured to periodically call over each input zone that has the wired connection and to receive, in response, the wired connection resistance parameters for each such input zone, wherein the controller is configured to compare the received wired connection resistance parameters with the predefined resistance parameters stored in the storage device, as well as to assign a status for each input zone, including an "alarm" status for the input zone that has the wired connection resistance parameters, which differ from the predefined resistance parameters, and wherein the controller is configured to form a data package that includes an information regarding a status of each input zone, for which the wired connection of the security sensors and/or fire annunciators has been performed, as well as regarding an operation status of the signal transmission device, and to send the formed data package via the radio module to a central station that is configured at least to inform regarding a receipt of the "alarm" status.

9. The device according to claim 8, wherein the storage device comprises the predefined resistance parameters, which include an interval of a "standard" resistance value that corresponds to a status of the alarm absence.

10. The device according to claim 9, wherein the interval of the "standard" resistance value includes intervals of "failure" resistance values, each of them being arranged near a boundary of the interval of the "standard" resistance value.

11. The device according to claim 10, wherein the controller is configured to assign a "failure" status for the input zone that has the wired connection resistance parameters, which correspond to one of the intervals of "failure" resistance values.

12. The device according to claim 8, wherein the power supply unit is configured to provide power from an alternating current mains and to provide power from an accumulator battery.

13. The device according to claim 8, wherein the device is further equipped with connection terminals for power circuits of the security sensors and connection terminals for power circuits of the fire annunciators.

14. The device according to claim 13, wherein the device further comprises a power supply unit for the security sensors and fire annunciators that is coupled to the power supply unit of the device and connected to the connection terminals for power circuits of the security sensors and connection terminals for power circuits of the fire annunciators.

15. The device according to claim 8, wherein the controller is suitable to measure the wired connection resistance of each input zone that comprises the connected security sensors and/or fire annunciators.

* * * * *